US010294886B2

(12) United States Patent
Nakajima et al.

(10) Patent No.: US 10,294,886 B2
(45) Date of Patent: May 21, 2019

(54) WATER JACKET STRUCTURE OF CYLINDER HEAD

(71) Applicant: Honda Motor Co.,Ltd., Tokyo (JP)

(72) Inventors: Masahiro Nakajima, Saitama (TW); Yoshiki Matsushiro, Chiba (JP); Koji Nakano, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/482,820

(22) Filed: Apr. 10, 2017

(65) Prior Publication Data

US 2017/0292471 A1 Oct. 12, 2017

(30) Foreign Application Priority Data

Apr. 11, 2016 (JP) ..... 2016-078911

(51) Int. Cl.
*F02F 1/24* (2006.01)
*F02F 1/40* (2006.01)

(52) U.S. Cl.
CPC ..... *F02F 1/40* (2013.01); *F02F 1/243* (2013.01)

(58) Field of Classification Search
CPC ..... F02F 1/40
See application file for complete search history.

(56) References Cited

U.S. PATENT DOCUMENTS

| | | | | |
|---|---|---|---|---|
| 8,061,131 | B2 | 11/2011 | Kuhlbach | |
| 2009/0126659 | A1* | 5/2009 | Lester | F01N 3/046 123/41.72 |
| 2014/0338314 | A1* | 11/2014 | Kuhlbach | F02F 1/243 60/323 |

FOREIGN PATENT DOCUMENTS

| | | |
|---|---|---|
| JP | 2002-070551 | 3/2002 |
| JP | 2014-084736 | 5/2014 |
| JP | 2014-084739 | 5/2014 |
| JP | 2015-059492 | 3/2015 |

OTHER PUBLICATIONS

"Office Action of Japan Counterpart Application," dated Jan. 24, 2018, with English translation thereof, p. 1-p. 4.
"Office Action of China Counterpart Application", dated Jan. 7, 2019, with English translation thereof, pp. 1-10.

* cited by examiner

*Primary Examiner* — Jacob M Amick
*Assistant Examiner* — Charles Brauch
(74) *Attorney, Agent, or Firm* — JCIPRNET

(57) ABSTRACT

A lower water jacket of a cylinder head includes a lower/upper exhaust collecting portion cooling portion configured between a lower exhaust collecting portion and an upper exhaust collecting portion by bypassing a lower exhaust collecting portion cooling portion. Besides, cooling water flowing through the lower/upper exhaust collecting portion cooling portion is merely cooling water of the lower water jacket, and cooling water of an upper water jacket does not flow through the lower/upper exhaust collecting portion cooling portion. Therefore, in the lower/upper exhaust collecting portion cooling portion, interference may not occur in cooling water of the two water jackets to restrain smooth flowing, and cooling effects of an area sandwiched by the lower exhaust collecting portion and the upper exhaust collecting portion are further improved.

2 Claims, 5 Drawing Sheets

WATER JACKET STRUCTURE OF CYLINDER HEAD

CROSS-REFERENCE TO RELATED APPLICATION

This application claims the priority benefit of Japan application serial no. 2016-078911, filed on Apr. 11, 2016. The entirety of the above-mentioned patent application is hereby incorporated by reference herein and made a part of this specification.

BACKGROUND OF THE INVENTION

1. Field of the Invention

The present invention relates to a water jacket (water jacket) structure of a cylinder head (cylinder head). A lower exhaust collecting portion and an upper exhaust collecting portion configured in a manner of being overlapped in an up-and-down direction, a lower water jacket configured below the lower exhaust collecting portion, and an upper water jacket configured above the upper exhaust collecting portion are formed inside a cylinder head. Cooling water is independent of one another and flows in a same direction inside the lower water jacket and the upper water jacket.

2. Description of Related Art

In a water-cooled in-line four-cylinder engine, according to the following Patent Document 1, the following water jacket structure of a cylinder head is already well-known. By means of the water jacket structure of a cylinder head, a lower exhaust collecting portion formed by integration of exhaust ports of a #1 cylinder and a #4 cylinder and an upper exhaust collecting portion formed by integration of exhaust ports of a #2 cylinder and a #3 cylinder are configured in a manner of being overlapped in an up-and-down direction, and a lower water jacket and an upper water jacket are formed in a manner of sandwiching the exhaust ports in the up-and-down direction, so that a middle water jacket communicated with the lower water jacket and the upper water jacket is configured between the lower exhaust collecting portion and the upper exhaust collecting portion. Therefore, by using cooling water flowing through the middle water jacket, cooling effects of vicinity, of the lower exhaust collecting portion and the upper exhaust collecting portion, that easily reaches a high temperature are improved.

PRIOR ART DOCUMENT

Patent Document

[Patent Document 1] U.S. Pat. No. 8,061,131

SUMMARY OF THE INVENTION

However, for the existing water jacket structure of a cylinder head, in two communication portions located at two ends of the middle water jacket, the lower water jacket, the upper water jacket, and the middle water jacket are mutually communicated. Therefore, in the two communication portions, interference may occur in cooling water in the three water jackets to restrain smooth flowing, and cooling effects generated by setting of the middle water jacket may not be fully played.

The present invention is an invention formed in view of the situation, and is directed to provide a water jacket structure of a cylinder head that can improve cooling effects of a cylinder head including a lower exhaust collecting portion and an upper exhaust collecting portion.

The invention provides a water jacket structure of a cylinder head is provided, where a lower exhaust collecting portion and an upper exhaust collecting portion that are configured in a manner of being overlapped in an up-and-down direction, a lower water jacket configured below the lower exhaust collecting portion, and an upper water jacket configured above the upper exhaust collecting portion are formed inside a cylinder head, cooling water is independent of one another and flows in a same direction inside the lower water jacket and the upper water jacket, and the water jacket structure of a cylinder head is characterized in that: the lower water jacket includes a lower exhaust collecting portion cooling portion opposite to a lower surface of the lower exhaust collecting portion, the upper water jacket includes an upper exhaust collecting portion cooling portion opposite to an upper surface of the upper exhaust collecting portion, one of the lower water jacket and the upper water jacket includes a lower/upper exhaust collecting portion cooling portion configured between the lower exhaust collecting portion and the upper exhaust collecting portion by bypassing the lower exhaust collecting portion cooling portion of the one water jacket, and the lower/upper exhaust collecting portion cooling portion is opposite to an upper surface of the lower exhaust collecting portion and a lower surface of the upper exhaust collecting portion.

In addition, the one water jacket may include volume expansion portions in a connection portion of the lower exhaust collecting portion cooling portion and the lower/upper exhaust collecting portion cooling portion of the one water jacket.

Further, as an example, a lower water jacket in the embodiments corresponds to the one water jacket in the present invention, a lower exhaust collecting portion cooling portion in the embodiments corresponds to the exhaust collecting portion cooling portion in the present invention, and a first volume expansion portion and a second volume expansion portion in the implementation manners correspond to the exhaust collecting portion cooling portions in the present invention.

According to the structure of the invention, a lower exhaust collecting portion and an upper exhaust collecting portion configured in a manner of being overlapped in an up-and-down direction, a lower water jacket configured below the lower exhaust collecting portion, and an upper water jacket configured above the upper exhaust collecting portion are formed inside a cylinder head, and cooling water is independent of one another and flows in a same direction inside the lower water jacket and the upper water jacket. The upper water jacket includes an upper exhaust collecting portion cooling portion opposite to a lower surface of the lower exhaust collecting portion, and the upper water jacket includes an upper exhaust collecting portion cooling portion opposite to an upper surface of the upper exhaust collecting portion. Therefore, the lower surface of the lower exhaust collecting portion may be cooled by using cooling water flowing through the lowerwater jacket, and the upper surface of the upper exhaust collecting portion may be cooled by using cooling water flowing through the upper water jacket.

In addition, one of the lower water jacket and the upper water jacket includes a lower/upper exhaust collecting portion cooling portion configured between the lower exhaust collecting portion and the upper exhaust collecting portion by bypassing the lower exhaust collecting portion cooling portion of the one water jacket. Therefore, an upper surface of the lower exhaust collecting portion and a lower surface of the upper exhaust collecting portion may be cooled by using cooling water flowing through the lower/upper exhaust collecting portion cooling portion. Therefore, cooling effects of an area, sandwiched by the lower exhaust collecting portion and the upper exhaust collecting portion, that easily reaches a high temperature are improved. Besides, the cooling water flowing through the lower/upper exhaust collecting portion cooling portion is merely cooling water of one water jacket, and cooling water of the other water jacket does not flow through the lower/upper exhaust collecting portion cooling portion. Therefore, in the lower/upper exhaust collecting portion cooling portion, interference may not occur in the cooling water of the lower water jacket and the upper water jacket to restrain smooth flowing, so that the cooling water can smoothly flow to the lower/upper exhaust collecting portion cooling portion, thereby further improving the cooling effects of the area sandwiched by the lower exhaust collecting portion and the upper exhaust collecting portion.

In addition, according to the structure of the invention, the one water jacket includes volume expansion portions in a connection portion of the lower exhaust collecting portion and the lower/upper exhaust collecting portion cooling portion of the one water jacket. Therefore, the cooling water may separately flow to the lower/upper exhaust collecting portion cooling portion from the one water jacket smoothly, and the cooling water may flow together to the one water jacket from the lower/upper exhaust collecting portion cooling portion smoothly. Therefore, the cooling effects of the lower exhaust collecting portion and the upper exhaust collecting portion are higher.

DESCRIPTION OF THE EMBODIMENTS

The following performs description on embodiments of the present invention on the basis of FIG. 1 to FIG. 5(A) and FIG. 5(B). Further, an up-and-down direction in this specification is not related to a carrying posture of an engine, a cylinder block (cylinder block) side in a cylinder axis direction is defined as a lower portion, and a cylinder head side in the cylinder axis direction is defined as an upper portion.

Figure 1:
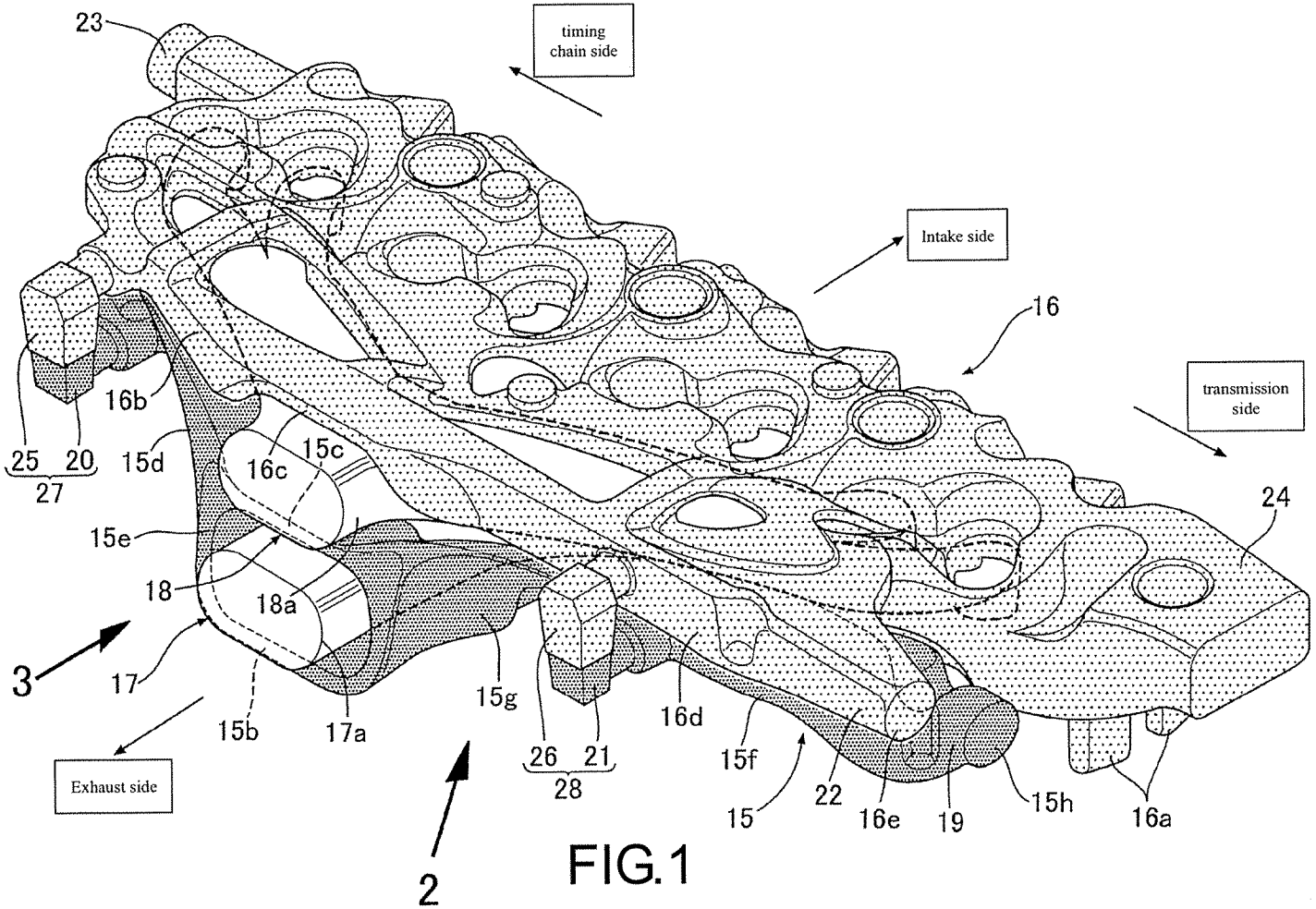
FIG. 1 is a perspective diagram of a water jacket.
Figure 2:
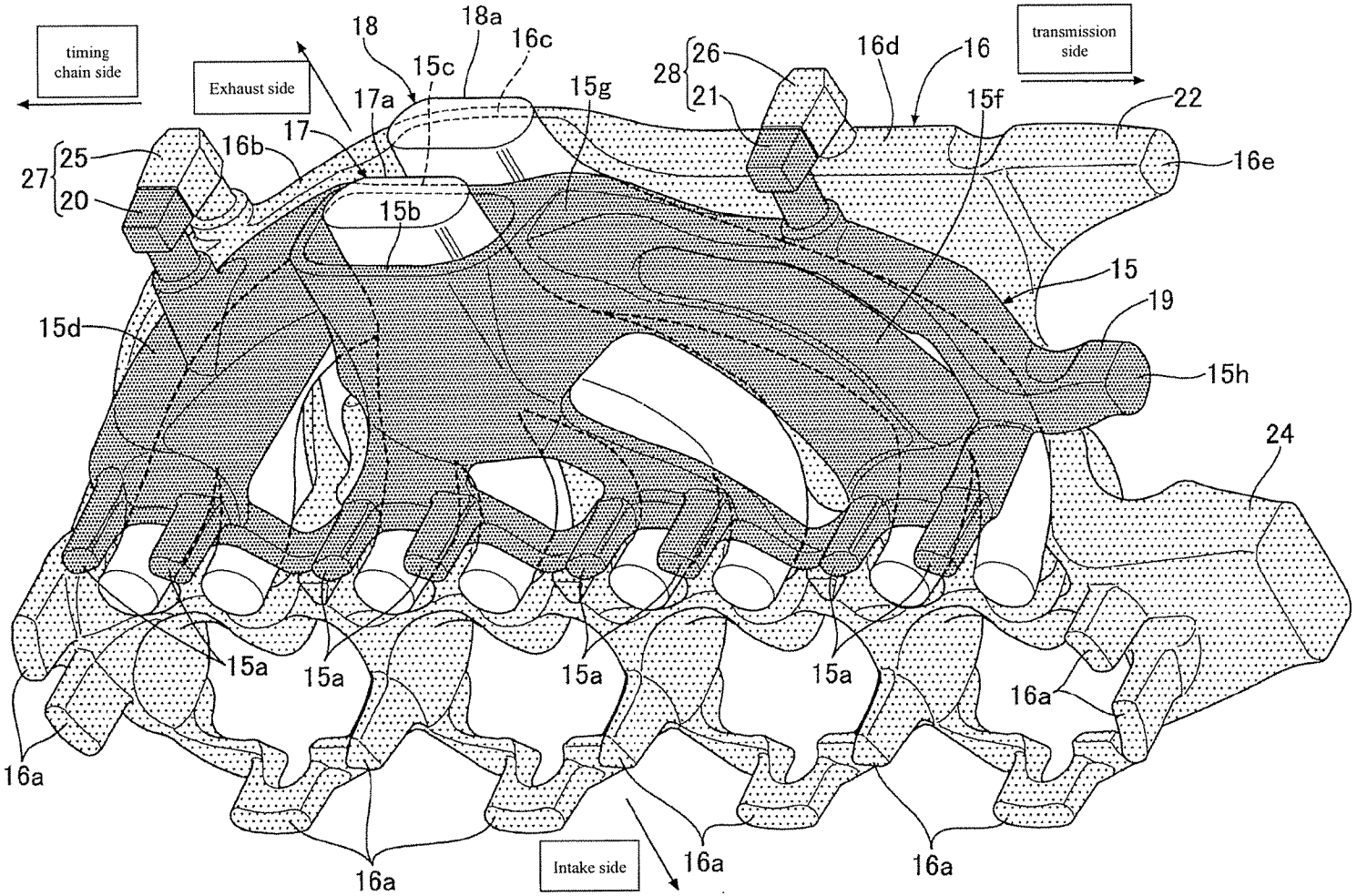
FIG. 2 is an arrow view in a direction 2 in FIG. 1.
Figure 3:
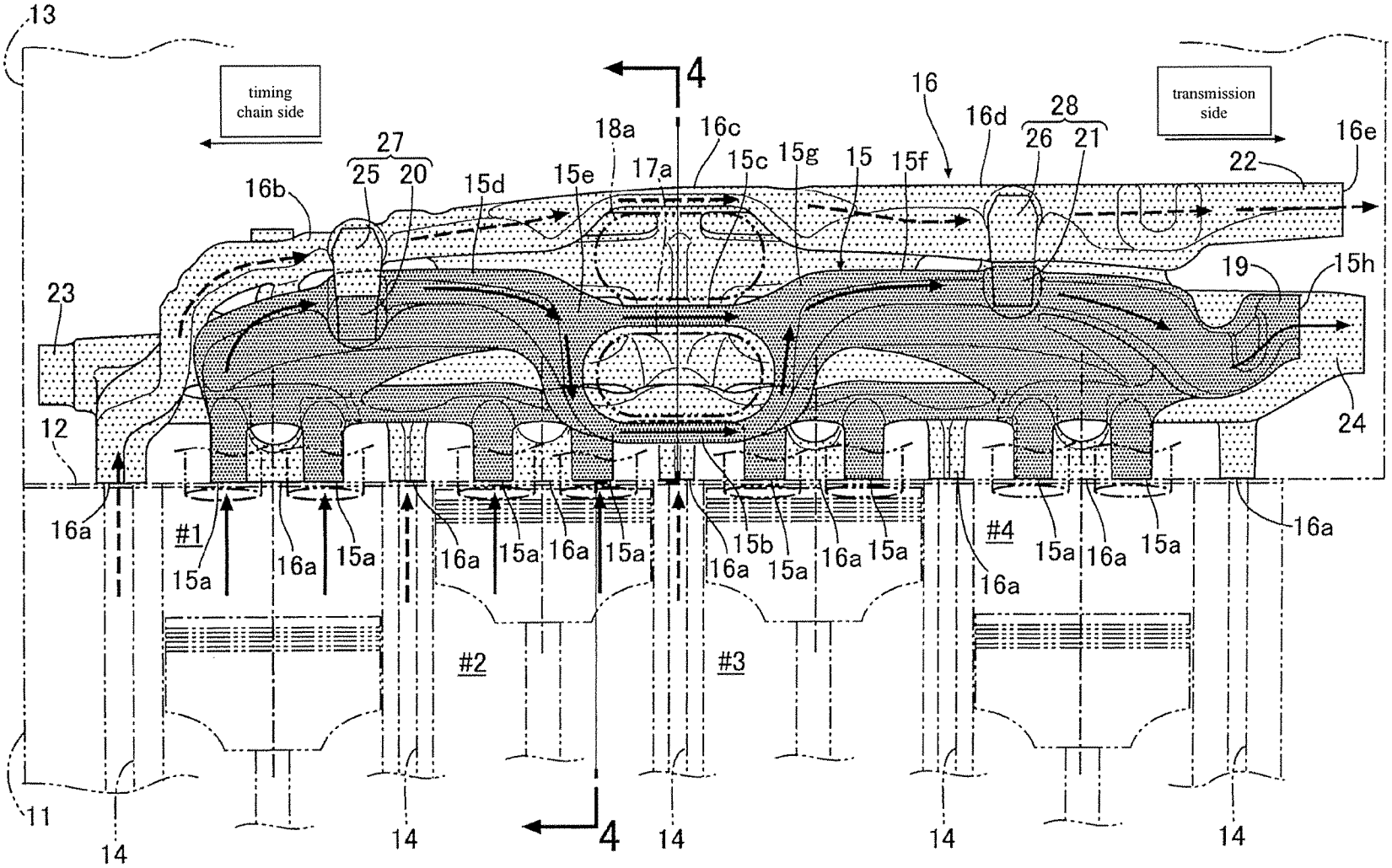
FIG. 3 is an arrow view in a direction 3 in FIG. 1.
Figure 4:
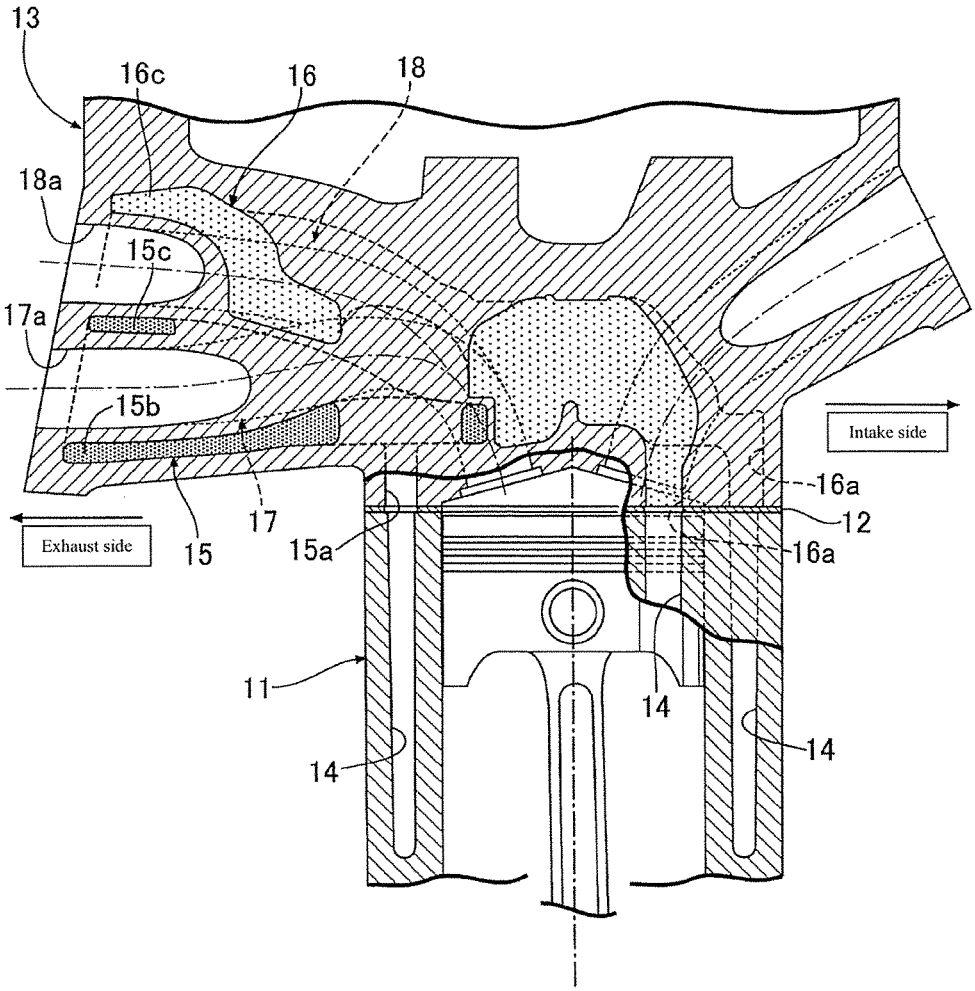
FIG. 4 is a sectional view at a line 4-4 in FIG. 3.
Figure 5A:
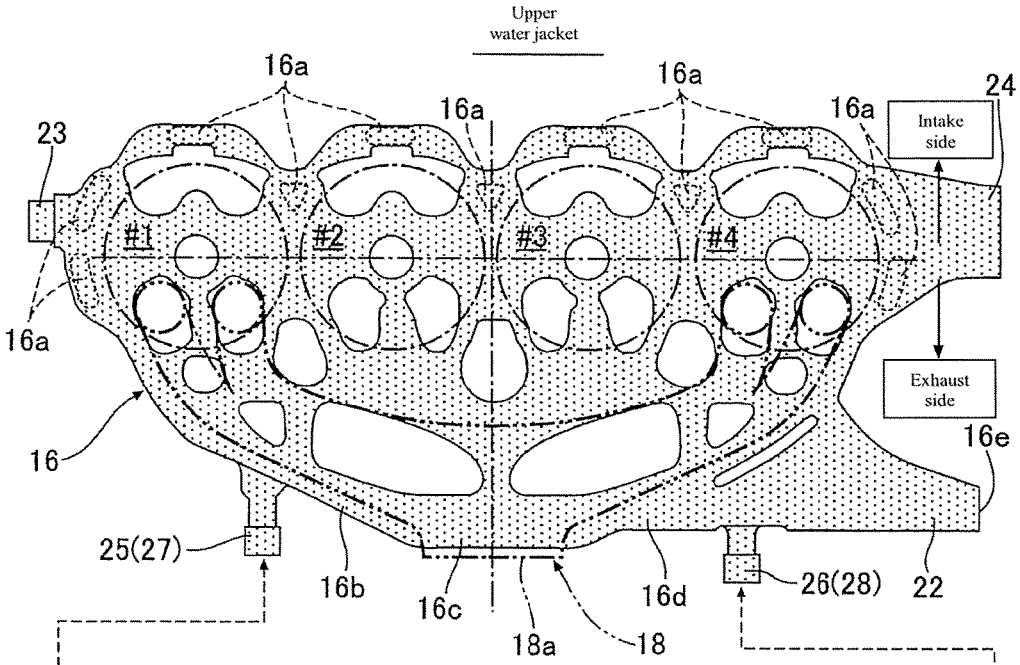
FIG. 5(A) and FIG. 5(B) are plan views of an upper water jacket and a lower water jacket.
Figure 5B:
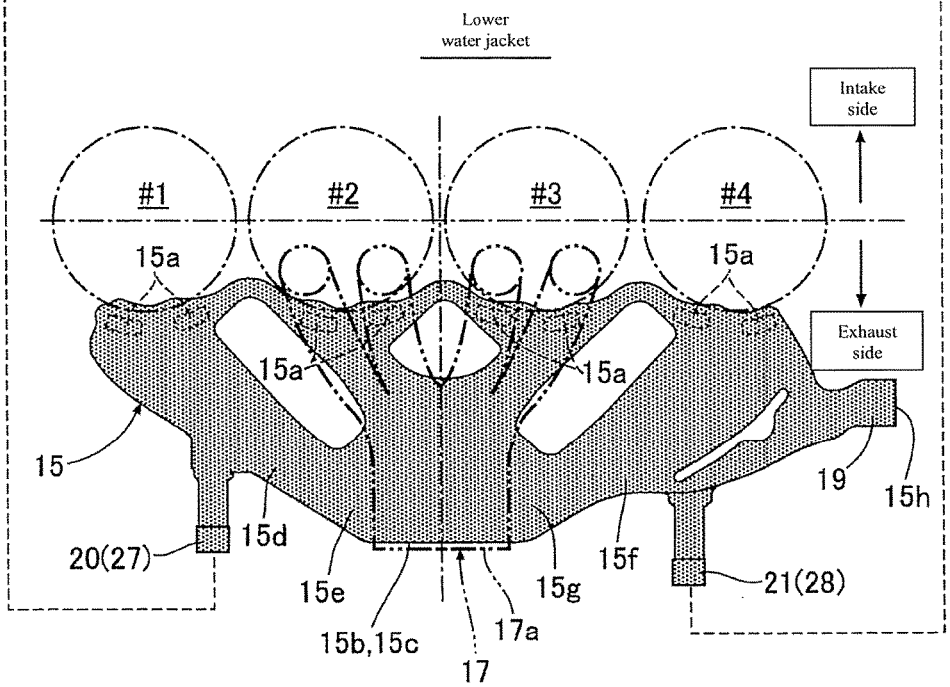

As shown in FIG. 3, a water-cooled in-line four-cylinder engine includes a cylinder block 11 and a cylinder head 13, where a bottom surface of the cylinder head 13 is bond, across a gasket (gasket) 12, with a top surface of the cylinder block 11. The cylinder block 11 includes a water jacket 14 encircling a periphery of four cylinder bores (cylinder bore) that are arranged in row along a row line of a cylinder, and cooling water is supplied from a cooling water pump not shown in the figure to the water jacket 14.

As shown in FIG. 1 to FIG. 5(A) and FIG. 5(B), a lower water jacket 15, an upper water jacket 16, a lower exhaust port 17, and an upper exhaust port 18 are formed inside the cylinder head 13, and the lower exhaust port 18 and the upper exhaust port 18 are configured in a manner of being sandwiched between the lower water jacket 15 and the upper water jacket 16. Further, shapes of the water jackets and the exhaust ports in the accompanying drawings are presented with shapes of mould cores forming the water jackets and the exhaust ports through casting.

The cylinder block 11 of the engine includes #1 cylinder to #4 cylinder from a timing chain (timing chain) side to a transmission side, and a timing chain is configured at the timing chain side for transferring a driving force of a crank shaft (crank shaft) to a cam shaft (cam shaft). The cylinder head 13 includes the lower exhaust ports 17, 17, an upper end of the lower exhaust ports 17, 17 is connected to exhaust holes of combustion chambers of the #2 cylinder and the #3 cylinder, and the lower exhaust port 17, 17 is integrated at a lower end to form a lower exhaust collecting portion 17*a* (referring to FIG. 5(B)). In addition, the cylinder head 13 includes the upper exhaust port 18, 18 an upper end of the upper exhaust port 18, 18 is connected to exhaust holes of combustion chambers of the #1 cylinder and the #4 cylinder, and the upper exhaust port 18, 18 is integrated at a lower end to form an upper exhaust collecting portion 18*a* (referring to FIG. 5(A)). The lower exhaust collecting portion 17*a* and the upper exhaust collecting portion 18*a* are overlapped in an up-and-down direction. When being observed from the top, an opening is formed in a side face at an exhaust side of the cylinder head 13 and at a middle position of the #2 cylinder and the #3 cylinder.

If exhaust ports of the #1 cylinder to the #4 cylinder are integrated into one exhaust collecting portion, the following problem exists: smooth discharging of waste gas is restrained due to exhaust interference, and output of an internal combustion engine is reduced. However, like this embodiment, the lower exhaust ports 17 of the #2 cylinder and the #3 cylinder whose exhaust is timed and discontinuous are integrated to be set as the lower exhaust collecting portion 17*a*, and the upper exhaust ports 18 of the #1 cylinder and the #4 cylinder whose exhaust is timed and discontinuous are integrated to be set as the upper exhaust collecting portion 18*a*. Therefore, exhaust interference can be prevented from, to improve the output of the internal combustion engine.

The lower water jacket 15 has a relatively small size and is only configured at an exhaust side of the #1 cylinder to the #4 cylinder, eight lower water jacket cooling-water inlets 15*a* (referring to FIG. 2) extend downwards along an end portion of an intake side of the lower water jacket 15, and these lower water jacket cooling-water inlets 15*a* are communicated with the water jacket 14, of the cylinder block 11, encircling a periphery of the #1 cylinder to the #4 cylinder. In addition, a lower exhaust collecting portion cooling portion 15*b* opposite to a lower surface of the lower exhaust collecting portion 17*a* and a lower/upper exhaust collecting portion cooling portion 15*c* opposite to an upper surface of the lower exhaust collecting portion 17*a* are formed at an end portion of an exhaust side of the lower water jacket 15. The lower exhaust collecting portion cooling portion 15*b* bent towards the lower surface of the lower exhaust collecting portion 17*a* into a convex shape is connected, in a ring manner, to the lower/upper exhaust collecting portion cooling portion 15*c* bent towards the upper surface of the lower exhaust collecting portion 17*a* into a convex shape, so as to encircle a periphery of the lower exhaust collecting portion 17*a*.

A first volume expansion portion 15*e* is formed at a lower side of a first cooling-water passage 15*d* extending along the end portion of the exhaust side of the lower water jacket 15 from the timing chain side to the lower exhaust collecting portion 17*a*, and a flow path sectional area of the first volume expansion portion 15*e* is gradually expanded towards the lower exhaust collecting portion cooling portion 15*b* and the lower/upper exhaust collecting portion cooling portion 15*c*. In addition, a second volume expansion portion 15*g* is formed at an upper side of a second cooling-water passage 15*f* extending along the end portion of the exhaust side of the lower water jacket 15 from the lower exhaust collecting portion 17*a* to the transmission side, and a flow path sectional area of the second volume expansion portion 15*g* is gradually expanded from the lower exhaust collecting portion cooling portion 15*b* and the lower/upper exhaust collecting portion cooling portion 15*c*.

The lower water jacket 15 includes three skirting base sections 19 to 21 (referring to FIG. 1) protruding outwards. The skirting base section 19 to the skirting base section 21 are protrusions for holding sand-made mould cores inside a mould when the cylinder head 13 is casted. The sand-made mould cores are used for forming the lower water jacket 15, and if the mould core is discharged after the casting, the skirting base section 19 to the skirting base section 21 may become an opening portion for forming a part of the lower ater jacket 15. An opening portion of the skirting base section 19 located at an end portion of the transmission side forms a lower water jacket cooling-water outlet 15*h*.

The upper water jacket 16 has a larger size compared with the lower water jacket 15, and is configured in a manner of crossing from an intake side to the exhaust side of the #1 cylinder to the #4 cylinder. 11 upper water jacket cooling-water inlets 16*a* (referring to FIG. 2) extend downwards along end portions of the timing chain side, the intake side, and the transmission side of the upper water jacket 16. These upper water jacket cooling-water inlets 16*a* are communicated with the water jacket 14, of the cylinder block 11, encircling the periphery of the #1 cylinder to the #4 cylinder.

In addition, a first cooling-water passage 16*b*, an upper exhaust collecting portion cooling portion 16*c*, and a second cooling-water passage 16*d* are formed in row along an end portion of an exhaust side of the upper water jacket 16 from the timing chain side to the transmission side. The upper exhaust collecting portion cooling portion 16*c* is bent towards an upper surface of the upper exhaust collecting portion 18*a* into a concave shape. The lower exhaust collecting portion cooling portion 15*b* of the lower water jacket 15 is connected to the lower/upper exhaust collecting portion cooling portion 15*c* in a manner of hanging at a lower end of the first cooling-water passage 15*d* and an upper end of the second cooling-water passage 15*f*. Therefore, an upper surface of the lower/upper exhaust collecting portion cooling portion 15*c* is bent towards a lower surface of the upper exhaust collecting portion 18*a* into a concave shape. Consequently, the upper surface and the lower surface of the upper exhaust collecting portion 18*a* are encircled by the upper exhaust collecting portion cooling portion 16*c* and the lower/upper exhaust collecting portion cooling portion 15*c*.

The upper water jacket 16 includes five skirting base sections 22 to 26 (referring to FIG. 1) protruding outwards. An opening portion of the skirting base section 22 located at the end portion of the transmission side forms an upper water jacket cooling-water outlet 16*e*. An opening portion of the skirting base section 23 located at an end portion of the timing chain side and an opening portion of the skirting base section 24 located at the end portion of the transmission side are sealed by a plug not shown in the figure.

The skirting base section 20 of the lower water jacket 15 located at the timing chain side of the lower exhaust collecting portion 17*a* is overlapped with the skirting base section 25 of the upper water jacket 16, opening portions are sealed by a plug not shown in the figure, and the lower water jacket 15 is communicated with the upper water jacket 16 by using a first aspirating hole 27 formed inside the skirting base section 20 and the skirting base section 25. In addition, the skirting base section 21 of the lower water jacket 15 located at the transmission side of the lower exhaust collecting portion 17*a* is overlapped with the skirting base section 26 of the upper water jacket 16, opening portions are sealed by a plug not shown in the figure, and the lower water jacket 15 is communicated with the upper water jacket 16 by using a second aspirating hole 28 formed inside the skirting base section 21 and the skirting base section 26.

Next, description is performed on functions of the embodiments in the present invention including the above structure.

Part of cooling water supplied by a cooling water pump not shown in the figure to the water jacket 14 of the cylinder block 11 is supplied to the lower water jacket 15 from here by passing through the lower water jacket cooling-water inlets 15*a*. When passing through the lower water jacket 15 from the timing chain side to the transmission side, the part of the cooling water performs cooling on the cylinder head 13 whose temperature is increased due to burning of fuel in combustion chambers in the #1 cylinder to the #4 cylinder, and is discharged from the lower water jacket cooling-water outlet 15*h*.

In addition, remaining part of the cooling water supplied to the water jacket 14 of the cylinder block 11 is supplied to the upper water jacket 16 from here by passing through the upper water jacket cooling-water inlets 16*a*. When passing through the upper water jacket 16 from the timing chain side to the transmission side, the remaining part of the cooling water performs cooling on the cylinder head 13, and is discharged from the upper water jacket cooling-water outlet 16*e*. In this period, cooling water flowing through the lower water jacket 15 and the cooling water flowing through the upper water jacket 16 are independent of one another, and may not be mutually mixed.

Bubbles included in the cooling water flowing through the lower water jacket 15 is discharged to the upper water jacket 16 by passing through the first aspirating hole 27 and the second aspirating hole 28, and is discharged, together with the cooling water, to an exterior of the cylinder head 13 from the upper water jacket 16. The first aspirating hole 27 is formed inside the skirting base section 20 of the lower water jacket 15 and the skirting base section 25 of the upper water jacket 16 that are overlapped up and down, and the second aspirating hole 28 is formed inside the skirting base section 21 of the lower water jacket 15 and the skirting base section 26 of the upper water jacket 16 that are overlapped up and down. In this case, the first aspirating hole 27 and the second aspirating hole 28 are provided at a highest position of the lower water jacket 15. Therefore, the bubbles lighter than the cooling water can be effectively discharged from the lower water jacket 15 to the upper water jacket 16.

In the cylinder head 13, vicinity of the lower exhaust collecting portion 17*a* and the upper exhaust collecting portion 18*a* through which waste gas discharged from the combustion chambers of the #1 cylinder to the #4 cylinder passes reaches a high temperature most easily, and in particular, a temperature of an area sandwiched by the lower exhaust collecting portion 17*a* and the upper exhaust collecting portion 18*a* is the highest.

After the cooling water flowing through the first cooling-water passage 15*d* of the lower water jacket 15 from the timing chain side to the transmission side separately flows from the first volume expansion portion 15*e* to the lower exhaust collecting portion cooling portion 15*b* and the lower/upper exhaust collecting portion cooling portion 15*c*, the cooling water together flows from the second volume expansion portion 15*g* to the second cooling-water passage 15*f*. However, in this case, the lower surface of the lower exhaust collecting portion 17*a* is cooled by cooling water flowing through the lower exhaust collecting portion cooling portion 15*b* opposite to the lower surface, and the upper surface of the lower exhaust collecting portion 17*a* is cooled by cooling water flowing through the lower/upper exhaust collecting portion cooling portion 15*c* opposite to the upper surface. Therefore, the cylinder head 13 around the lower exhaust collecting portion 17*a* that easily reaches a high temperature is effectively cooled. In addition, the upper surface of the upper exhaust collecting portion 18*a* is cooled by cooling water flowing through the upper exhaust collecting portion cooling portion 16*c* opposite to the upper surface, and the lower surface of the upper exhaust collecting portion 18*a* is cooled by the cooling water flowing through the lower/upper exhaust collecting portion cooling portion 15*c* opposite to the lower surface. Therefore, the cylinder head 13 around the upper exhaust collecting portion 18*a* that easily reaches a high temperature is effectively cooled.

In this case, the lower/upper exhaust collecting portion cooling portion 15*c* configured between the lower exhaust collecting portion 17*a* and the upper exhaust collecting portion 18*a* forms a part of the lower water jacket 15, and is separated from the upper water jacket 16. Therefore, the cooling water flowing through the lower/upper exhaust collecting portion cooling portion 15*c* and the cooling water flowing through the upper water jacket 16 are prevented from mutual interference, the cooling water in the lower/upper exhaust collecting portion cooling portion 15*c* may smoothly flow, and cooling efficiency of the lower exhaust collecting portion 17*a* and the upper exhaust collecting portion 18*a* is improved.

In addition, a part in which the first cooling-water passage 15*d* of the lower water jacket 15 is branched into the lower exhaust collecting portion cooling portion 15*b* and the lower/upper exhaust collecting portion cooling portion 15*c* is formed with the first volume expansion portion 15*e* whose flow path sectional area is gradually expanded, and a part in which the lower exhaust collecting portion cooling portion 15*b* and the lower/upper exhaust collecting portion cooling portion 15*c* are integrated into the second cooling-water passage 15*f* is formed with the second volume expansion portion 15*g* whose flow path sectional area is gradually shrunk. Therefore, cooling water in the first volume expansion portion 15*e* and the second volume expansion portion 15*g* can be prevented from stagnation, so that the cooling water in the lower exhaust collecting portion cooling portion 15*b* and the lower/upper exhaust collecting portion cooling portion 15*c* can smoothly flow.

When the cylinder head 13 is casted by using a mould, the water jacket of the cylinder head 13 is shaped by using a mould core. However, in this embodiment, the cooling water flowing through the lower water jacket 15 and the upper water jacket 16 may almost not be mixed, but flows independently. Therefore, a mould core of the lower water jacket 15 and a mould core of the upper water jacket 16 may be formed in an uncrossed and independent manner. Therefore, structure of the mould core can be simplified, and manufacturing costs can be reduced.

In particular, the lower/upper exhaust collecting portion cooling portion 15*c* of the lower water jacket 15 is not communicated with the upper water jacket 16. Therefore, a mould core enabling the lower/upper exhaust collecting portion cooling portion 15*c* to be shaped is not independently provided, but may be integrated with the mould core of the lower water jacket 15, so that a quantity of mould cores can be reduced, to reduce the manufacturing costs.

In addition, the lower exhaust collecting portion cooling portion 15*b* and the lower/upper exhaust collecting portion cooling portion 15*c* of the lower water jacket 15 are of a shape (referring to FIG. 3) of hanging in the first volume expansion portion 15*e* and the second volume expansion portion 15*g*. Therefore, strength of a part, in the mould core of the lower water jacket 15, corresponding to the lower exhaust collecting portion cooling portion 15*b* and the lower/upper exhaust collecting portion cooling portion 15*c* is improved, so that the following case can be prevented, where the case refers to that the part corresponding to the lower exhaust collecting portion cooling portion 15*b* and the lower/upper exhaust collecting portion cooling portion 15*c* may be out of shape during mould core storage.

The foregoing performs description on the embodiments of the present invention, but various designs and modifications may be performed on the present invention without departing from the scope of the purpose.

For example, the engine in the embodiments is an in-line four-cylinder engine, but a quantity or arrangement of cylinders of the engine is not limited to the embodiments.

What is claimed is:

1. A water jacket structure of a cylinder head, wherein a lower exhaust collecting portion (17*a*) and an upper exhaust collecting portion (18*a*) that are configured in a manner of being overlapped in an up-and-down direction, a lower water jacket (15) configured below the lower exhaust collecting portion (17*a*), and an upper water jacket (16) configured above the upper exhaust collecting portion (18*a*) are formed inside a cylinder head (13), and cooling water is independent of one another and flows in a same direction inside the lower water jacket (15) and the upper water jacket (16), and the lower water jacket (15) comprises a lower exhaust collecting portion cooling portion (15*b*) opposite to a lower surface of the lower exhaust collecting portion (17*a*), the upper water jacket (16) comprises an upper exhaust collecting portion cooling portion (16*c*) opposite to an upper surface of the upper exhaust collecting portion (18*a*), one of the lower water jacket (15) and the upper water jacket (16) comprises a lower/upper exhaust collecting portion cooling portion (15*c*) configured between the lower exhaust collecting portion (17*a*) and the upper exhaust collecting portion (18*a*) by bypassing one of the lower exhaust collecting portion cooling portion (15*b*) of the lower water jacket (15) and the upper exhaust collecting portion cooling portion (16*c*) of the upper water jacket (16), and the lower/upper exhaust collecting portion cooling portion (15*c*) is opposite to an upper surface of the lower exhaust collecting portion (17*a*) and a lower surface of the upper exhaust collecting portion (18*a*), wherein the one of the lower exhaust collecting portion cooling portion (15*b*) of the lower water jacket (15) and the upper exhaust collecting portion cooling portion (16*c*) of the upper water jacket (16) connects with the lower/upper exhaust collecting portion cooling portion (15*c*) through only two connection portions having volume expansion portions (15*e*, 15*g*).

2. A water jacket structure of a cylinder head, wherein a lower exhaust collecting portion (17*a*) and an upper exhaust collecting portion (18*a*) that are configured in a manner of being overlapped in an up-and-down direction, a lower water jacket (15) configured below the lower exhaust collecting portion (17*a*), and an upper water jacket (16) configured above the upper exhaust collecting portion (18*a*) are formed inside a cylinder head (13), and cooling water is independent of one another and flows in a same direction inside the lower water jacket (15) and the upper water jacket (16), and the lower water jacket (15) comprises a lower exhaust collecting portion cooling portion (15*b*) opposite to a lower surface of the lower exhaust collecting portion (17*a*), the upper water jacket (16) comprises an upper exhaust collecting portion cooling portion (16*c*) opposite to an upper surface of the upper exhaust collecting portion (18*a*), the lower water jacket (15) comprises a lower/upper exhaust collecting portion cooling portion (15*c*) configured between the lower exhaust collecting portion (17*a*) and the upper exhaust collecting portion (18*a*) by bypassing the exhaust collecting portion cooling portion (15*b*) of the lower water jacket (15), and the lower/upper exhaust collecting portion cooling portion (15*c*) is opposite to an upper surface of the lower exhaust collecting portion (17*a*) and a lower surface of the upper exhaust collecting portion (18*a*), wherein the lower exhaust collecting portion cooling portion (15*b*) is connected to the lower/upper exhaust collecting portion cooling portion (15*c*) in a manner of hanging at a lower end of an upstream passage (15*d*) and an upper end of an downstream passage (15*f*), an upper surface of the lower/upper exhaust collecting portion cooling portion (15*c*) is bent towards a lower surface of the upper exhaust collecting portion (18*a*) into a concave shape.

* * * * *